US007490880B1

(12) United States Patent
Matsui

(10) Patent No.: US 7,490,880 B1
(45) Date of Patent: Feb. 17, 2009

(54) TOOL AND METHOD OF USE

(76) Inventor: Jason M. Matsui, 1644 Portofino Dr., Yuba City, CA (US) 95993

( * ) Notice: Subject to any disclaimer, the term of this patent is extended or adjusted under 35 U.S.C. 154(b) by 0 days.

(21) Appl. No.: 11/567,535

(22) Filed: Dec. 6, 2006

(51) Int. Cl.
*B25J 1/00* (2006.01)
*B25J 1/12* (2006.01)

(52) U.S. Cl. ..... 294/19.1; 294/26

(58) Field of Classification Search ..... 294/15, 294/26, 19.1, 65.5; 15/144.4; D8/14; 16/429, 16/431, 436; 410/143, 145, 151
See application file for complete search history.

(56) References Cited

U.S. PATENT DOCUMENTS 5,169,190 A * 12/1992 Franklin ..... 294/15
5,171,052 A 12/1992 Cunningham
5,381,319 A 1/1995 Shiao
5,411,238 A 5/1995 Caron
5,487,576 A * 1/1996 DuVivier ..... 294/19.1
5,502,864 A 4/1996 Sorenson
5,647,623 A 7/1997 Shiao
6,065,787 A 5/2000 Jarosch
6,270,133 B1 * 8/2001 Babcock ..... 294/15
6,293,601 B1 9/2001 Johnson
6,450,557 B1 9/2002 Martinez
D497,086 S 10/2004 Lopes
2004/0100109 A1 5/2004 Johnson
2005/0200143 A1 * 9/2005 Maestas ..... 294/65.5

FOREIGN PATENT DOCUMENTS

DE 3246527 * 6/1984 ..... 294/49

* cited by examiner

*Primary Examiner*—Paul T Chin

(57) ABSTRACT

A tool for retrieving articles positioned in a bed of a vehicle that are out of reach includes a handle sleeve being graspable to facilitate manipulation of the handle sleeve. An extension rod is slidably mounted to the handle sleeve. The extension arm is telescopic to vary a length of the extension rod. The extension rod is extended from the handle sleeve when the extension rod is lengthened. A portion of the extension rod is positioned in the handle sleeve when the extension rod is retracted. An offset arm is coupled to a free end of the extension rod. A retrieval arm is hingedly coupled to the offset arm. The retrieval arm is pivoted between a deployed position aligned with the offset arm and a stored position.

4 Claims, 4 Drawing Sheets

FIG. 3
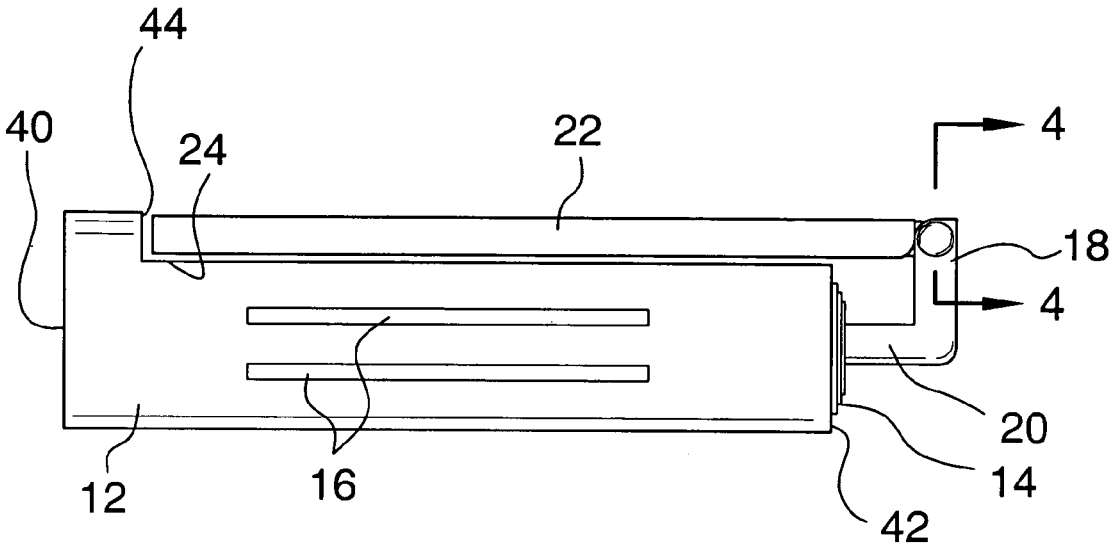
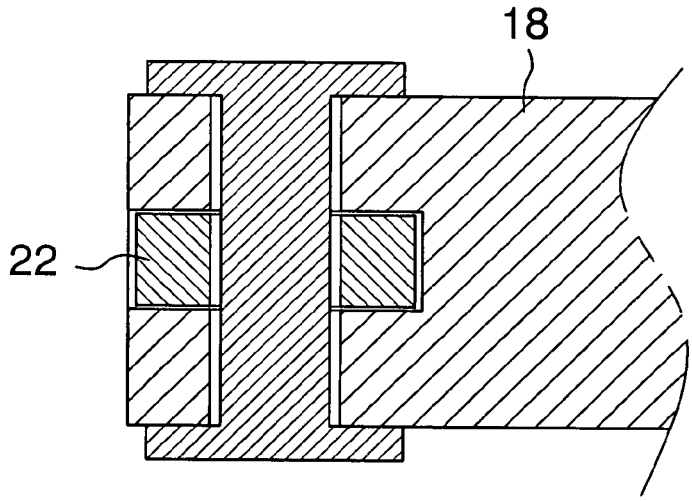
FIG. 4

TOOL AND METHOD OF USE

BACKGROUND OF THE INVENTION

1. Field of the Invention

The present invention relates to retrieval tools and more particularly pertains to a new retrieval tool for retrieving articles positioned in a bed of a vehicle that are out of reach.

2. Description of the Prior Art

The use of retrieval tools is known in the prior art. While these devices fulfill their respective, particular objectives and requirements, the need remains for a device that has certain improved features that allow for the device to be compactly stored to prevent damage to the device. Additionally, the device should be magnetically securable to a vehicle to maintain the device in a desired location.

SUMMARY OF THE INVENTION

The present invention meets the needs presented above by generally comprising a handle sleeve being graspable to facilitate manipulation of the handle sleeve. An extension rod is slidably mounted to the handle sleeve. The extension arm is telescopic to vary a length of the extension rod. The extension rod is extended from the handle sleeve when the extension rod is lengthened. A portion of the extension rod is positioned in the handle sleeve when the extension rod is retracted. An offset arm is coupled to a free end of the extension rod. A retrieval arm is hingedly coupled to the offset arm. The retrieval arm is pivoted between a deployed position aligned with the offset arm and a stored position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such descriptions makes reference to the annexed drawings wherein:

FIG. 3 is a side view of the present invention shown retracted.

FIG. 4 is a cross-sectional view of the present invention taken along line 4-4 of FIG. 3.

DESCRIPTION OF THE PREFERRED EMBODIMENT

Figure 2:
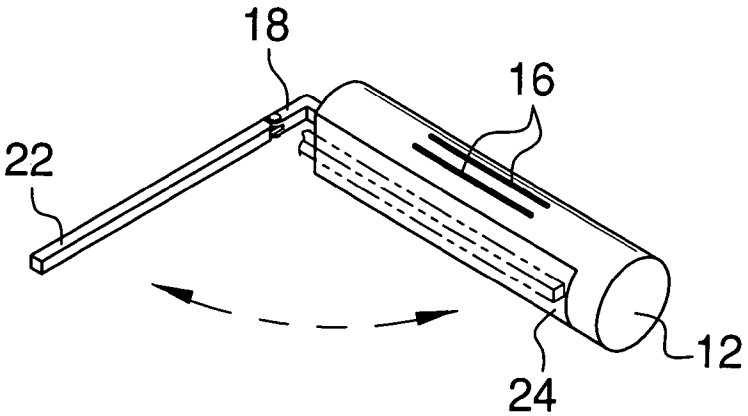
FIG. 2 is a perspective view of the present invention shown retracted.
Figure 1:
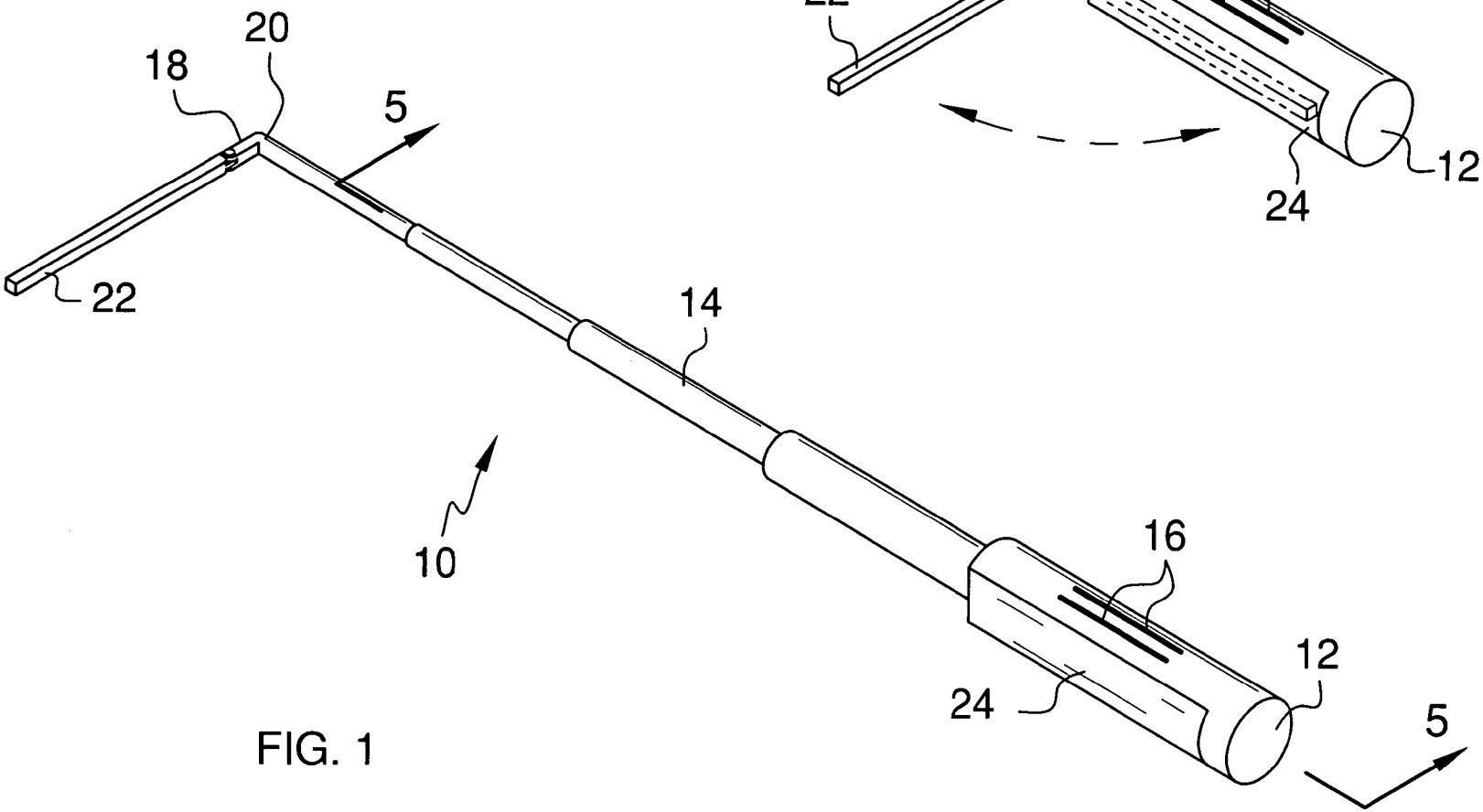
FIG. 1 is a perspective view of a tool and method of use according to the present invention shown extended.
Figure 5:
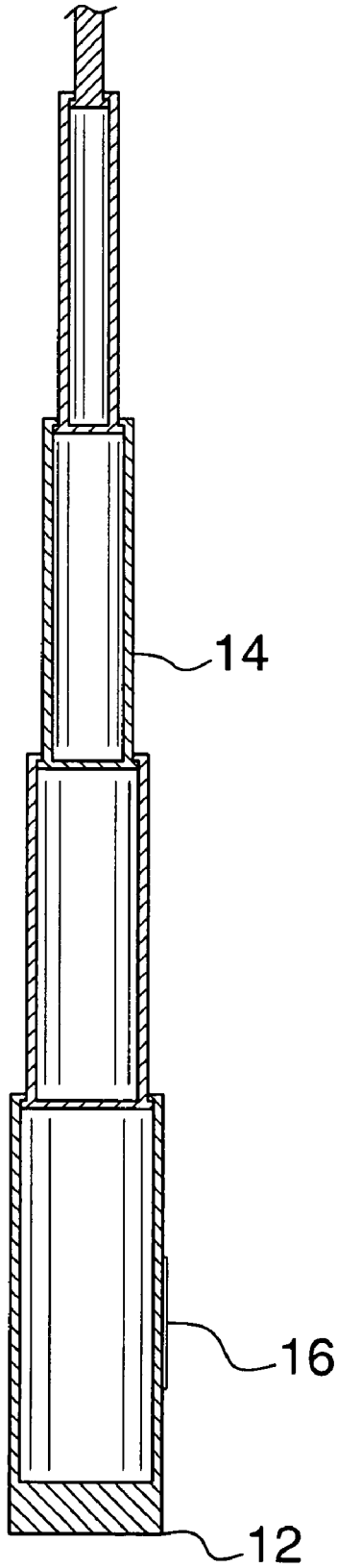
FIG. 5 is a cross-sectional view of the present invention taken along line 5-5 of FIG. 1.
Figure 6:
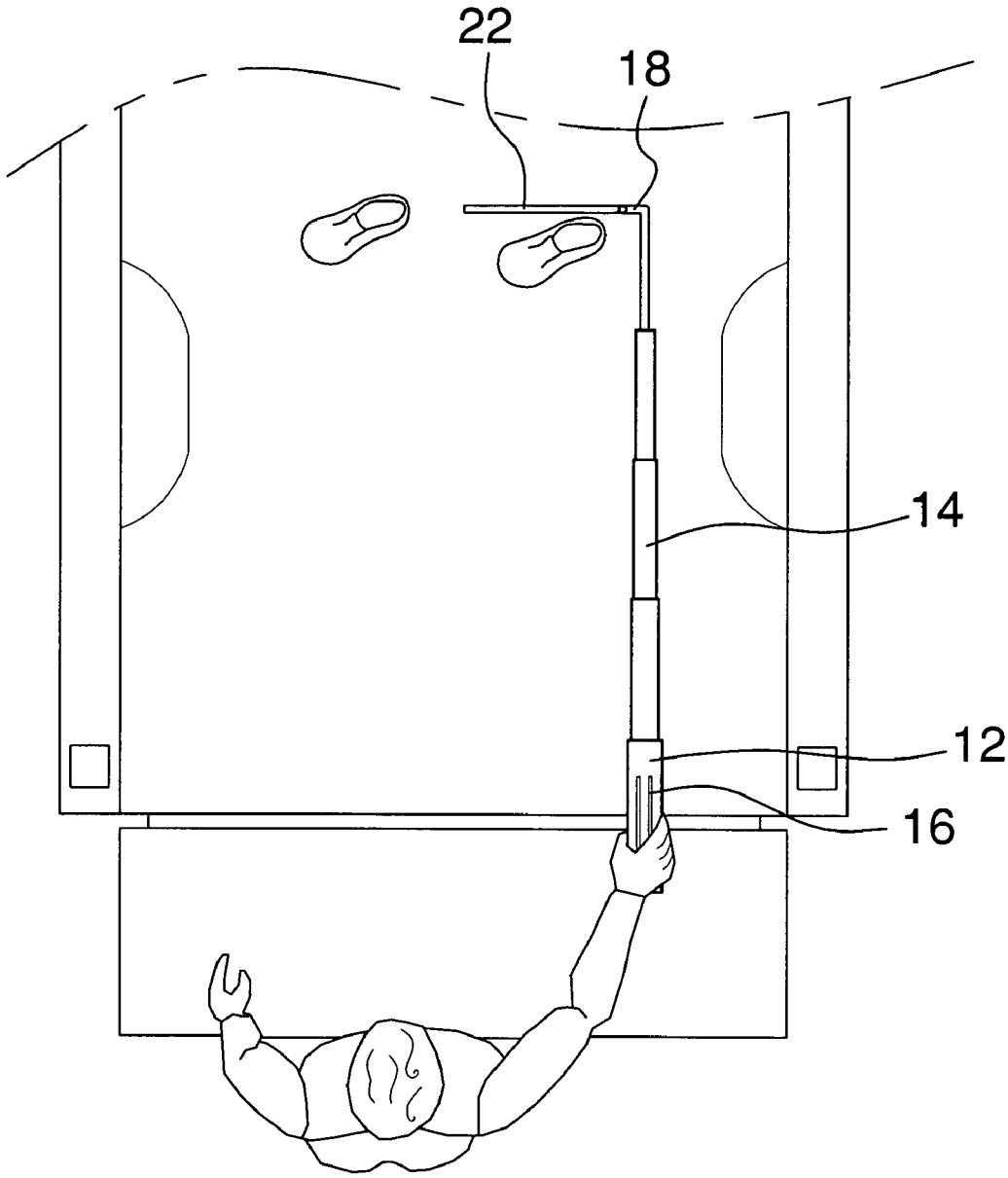
FIG. 6 is a top view of the present invention shown in use.

With reference now to the drawings, and in particular to FIGS. 1 through 6 thereof, a new retrieval tool embodying the principles and concepts of the present invention and generally designated by the reference numeral 10 will be described.

As best illustrated in FIGS. 1 through 6, the tool and method of use 10 generally comprises a handle sleeve 112 being graspable to facilitate manipulation of the handle sleeve 12. An extension rod 14 is slidably mounted to the handle sleeve 12. The extension arm is telescopic to vary a length of the extension rod 14. The extension rod 14 is extended from the handle sleeve 12 when the extension rod 14 is lengthened. A portion of the extension rod 14 is positioned in the handle sleeve 12 when the extension rod 14 is retracted. At least one magnet 16 is coupled to the handle sleeve 12. The at least one magnet 16 is magnetically attracted to a vehicle to secure the handle sleeve 12 in a desire location.

An offset arm 18 is coupled to a free end 20 of the extension rod 14. The offset arm 18 is positioned approximately perpendicular to the extension rod 14. A retrieval arm 22 is hingedly coupled to the offset arm 18. The retrieval arm 22 is pivoted between a deployed position aligned with the offset arm 18 and a stored position. The stored position is defined by the retrieval arm 22 being positioned orthogonally to the offset arm 18 and extending back towards the handle sleeve 12. The retrieval arm 22 is positioned adjacent a planar face 24 of the handle sleeve 12 when the retrieval arm 22 is in the stored position and the extension rod 14 is retracted into the handle sleeve 12. The handle sleeve includes a first end 40 and a second end 42 and the extension rod 14 is attached to the second end. The planar face 24 extends from the second end 40 to a flange 44 abutting the first end 40. The retrieval arm extends to the flange 44 when the retrieval arm is in the stored position. The handle sleeve 12 is cylindrically shaped and the planar face 24 forms a depression in the handle sleeve 12.

In use, the retrieval arm 22 is positioned in the deployed position and abutted against articles in a bed of the vehicle. The articles are slid out of the bed when the handle sleeve 12 and the extension rod 14 are pulled out of the bed. The retrieval arm 22 is positioned in the stored position. The handle sleeve 12 is attached to a metallic surface of the vehicle with the magnet 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for retrieving articles from a bed of a vehicle, said tool comprising:

a handle sleeve being graspable to facilitate manipulation of said handle sleeve;

an extension rod being slidably mounted to said handle sleeve, said extension arm being telescopic to vary a length of said extension rod, said extension rod being extended from said handle sleeve when said extension rod is lengthened, a portion of said extension rod being positioned in said handle sleeve when said extension rod is retracted;

an offset arm being coupled to a free end of said extension rod;

a retrieval arm being hingedly coupled to said offset arm, said retrieval arm being pivoted between a deployed position aligned with said offset arm and a stored position;

said stored position being defined by said retrieval arm being positioned orthogonally to said offset arm and extending back towards said handle sleeve, said retrieval ram being positioned adjacent a planar face of said handle sleeve when said retrieval arm is in said stored position and said extension rod is retracted into said handle sleeve; and said handle sleeve including a first end and a second end, said extension rod being attached to said second end, a flange being attached to said handle sleeve and abutting said first end, said planar face extending from said second end to said flange, said retrieval arm extending to said flange when said retrieval arm is in the stored position.

2. The tool according to claim 1, wherein said offset arm is positioned approximately perpendicular to said extension rod.

3. The tool according to claim 1, wherein at least one magnet is coupled to said handle sleeve.

4. A method for retrieving articles from a bed of a vehicle, said method comprising:

providing a handle sleeve being graspable to facilitate manipulation of said handle sleeve;

providing an extension rod being slidably mounted to said handle sleeve, said extension arm being telescopic to vary a length of said extension rod, said extension rod being extended from said handle sleeve when said extension rod is lengthened, a portion of said extension rod being positioned in said handle sleeve when said extension rod is retracted;

providing an offset arm being coupled to a free end of said extension rod, said offset arm being positioned approximately perpendicular to said extension rod;

providing a retrieval arm being hingedly coupled to said offset arm, said retrial arm being pivoted between a deployed position aligned with said offset arm and a stored position, said stored position being defined by said retrieval arm being positioned orthogonally to said offset arm and extending back towards said handle sleeve, said retrieval arm being positioned adjacent a planar face of said handle sleeve when said retrieval arm is in said stored position and said extension rod is retracted into said handle sleeve, said handle sleeve including a first end and a second end, said extension rod being attached to said second end, a flange being attached to said handle sleeve and abutting said first end, said planar face extending from said second end to said flange, said retrieval arm extending to said flange when said retrieval arm is in the stored position;

providing at least one magnet being coupled to said handle sleeve;

positioning said retrieval arm in said deployed position and abutting said retrieval arm against the articles in the bed of the vehicle;

sliding said article out of the bed when said handle sleeve and said extension rod are pulled out of the bed;

positioning said retrieval arm in said stored position; and attaching said handle sleeve to a metallic surface of the vehicle with said magnet.

* * * * *